US005339290A

United States Patent [19]

Greenstein

[11] Patent Number: 5,339,290

[45] Date of Patent: Aug. 16, 1994

[54] MEMBRANE HYDROPHONE HAVING INNER AND OUTER MEMBRANES

[75] Inventor: Michael Greenstein, Los Altos, Calif.

[73] Assignee: Hewlett-Packard Company, Palo Alto, Calif.

[21] Appl. No.: 49,681

[22] Filed: Apr. 16, 1993

[51] Int. Cl.[5] ..... H04R 17/00

[52] U.S. Cl. ..... 367/163; 310/324; 310/800

[58] Field of Search ..... 367/163, 174, 140; 310/324, 800

[56] References Cited

U.S. PATENT DOCUMENTS

| | | | |
|---|---|---|---|
| 4,433,400 | 2/1984 | DeReggi et al. | 367/163 |
| 4,651,310 | 3/1987 | Kaneko et al. | 367/140 |
| 4,653,036 | 3/1987 | Harris et al. | 367/170 |
| 4,789,971 | 12/1988 | Powers et al. | 367/152 |
| 5,035,247 | 7/1991 | Heimann | 128/715 |
| 5,072,426 | 11/1991 | Schafer et al. | 310/800 |

OTHER PUBLICATIONS

Brendel, Klaus et al., "Hydrophone Measurements," Ch. 5, Part A, *Ultrasonic Exposimetry,* Ed. Marvin C. Ziskin et al., CRC Press, pp. 116–125.

DeReggi, A. S. et al., "Piezoelectric polymer probe for ultrasonic applications," *J. Acoust. Soc. Am.,* vol. 69, No. 3, Mar. 1981, pp. 853–859.

Preston, R. C. et al., "PVDF membrane hydrophone performance properties and their relevance to the measurement of the acoustic output of medical ultrasonic equipment," *J. Phys. E: Sci. Instrum.,* vol. 16, 1983, pp. 786–796.

Shottow et al., "A PVDF membrane hydrophone for operation in the range of 0.5 MHz to 15 MHz," *Ultrasonics,* May 1980, pp. 123–126.

*Primary Examiner*—Ian J. Lobo

[57] ABSTRACT

An acoustic device, such as a membrane hydrophone, includes a support structure and an outer membrane that suspends a transducer membrane within the interior of the support structure. The transducer membrane is selected for its acoustic and piezoelectric properties and is preferably a polymer such as P(VDF-TrFE). The outer suspension membrane is selected primarily for its mechanical properties. Portions of the suspension membrane may be removed in order to reduce mechanical drag encountered during movement of the device in a liquid. The transducer membrane includes at least one active area that is poled to provide a piezoelectrically strong region. Electrical charge generated at the active area is amplified at a preamp for transmission to remote equipment.

20 Claims, 6 Drawing Sheets

MEMBRANE HYDROPHONE HAVING INNER AND OUTER MEMBRANES

TECHNICAL FIELD

The present invention relates generally to acoustic devices and more particularly to membrane hydrophones.

BACKGROUND ART

Ultrasonic devices may be used in a wide variety of applications, such as acoustic pressure sensors for ultrasonic field characterization. A hydrophone is a type of ultrasonic device that has been employed as an acoustic pressure sensor in the medical field to calibrate an ultrasonic transducer used in medical diagnosis and therapy. Calibration of the ultrasonic transducer can be achieved by directing waves from the transducer to the hydrophone. The hydrophone is operated to provide a quantitative assessment of the characteristics of ultrasonic fields that are created by the transducer in a liquid, such as water.

Performance properties such as sensitivity, frequency response, acoustic transparency and immunity to rf interference must be considered in the design of a hydrophone for ultrasonic field characterization. One type of hydrophone design is a needle-like device described in U.S. Pat. No. 4,789,971 to Powers et. al. Despite the small size of the needle-like hydrophone, this type unavoidably changes the ultrasonic field that is to be characterized. Perturbations of the field are generated as a result of the geometry of the hydrophone and the substantial difference in acoustic impedance between the hydrophone and the liquid in which the hydrophone is immersed.

A membrane hydrophone is a type of device that is generally more acoustically transparent than the needle-like devices. Membrane hydrophones are described in U.S. Pat. Nos. 4,433,400 to DeReggi et. al. and 4,653,036 to Harris et. al. Such hydrophones typically include a thin polyvinylidene fluoride (PVDF) film that is held taut by a rigid hoop. PVDF membranes are employed because the acoustic impedance of PVDF is relatively close to that of water. Impedance matching reduces the reflections generated by the hydrophone. Moreover, the diameter of the hoop is typically several times as large as the diameter of the acoustic beams that are to be encountered, so that the hoop is less likely to generate perturbations.

Shielding from rf interference can be achieved by employing a bilaminate design, rather than a single-sheet PVDF design. The bilaminate structure allows the external surfaces of the membrane to be coated with a metallization which is at ground potential.

Membrane hydrophones having an acceptable sensitivity over a frequency range of 0.5 MHz to 15 MHz are well known. The size of the active sensing area should be smaller than the wavelength of the highest frequency to be encountered. To this end, only a small area of the PVDF membrane is poled using a combination of elevated temperature and a nominal applied electric field. The poling process provides a strongly piezoelectrically active area. The above-cited patent to DeReggi et. al. describes a centrally located active area having a diameter of 0.5 mm.

The thickness of the PVDF membrane also plays a role in determining the frequency response performance of the hydrophone. A thin membrane will have a higher operating frequency than a thick membrane. However, there is a tradeoff between frequency response and mechanical rigidity. A thin membrane is susceptible to breakage since, as previously noted, the hydrophone should have a diameter that is several times as large as the diameter of the ultrasonic field that is to be characterized. A standard thickness of a hydrophone PVDF film is 25 μm.

It is an object of the present invention to provide an acoustic membrane device, such as a membrane hydrophone, having an extended frequency range without a loss of mechanical rigidity.

SUMMARY OF THE INVENTION

The above object has been met by an acoustic device in which a piezoelectric membrane is held taut by a support structure, but is suspended in spaced relation to the support structure by a suspension membrane. Because the lateral dimensions of the piezoelectric membrane are less than would be necessary if the piezoelectric membrane were to be linked in a conventional manner directly to the support structure, the thickness of the piezoelectric membrane can be reduced without rendering the device unacceptably susceptible to damage.

In a preferred embodiment, the acoustic device is a membrane hydrophone and the support structure has the shape of a hoop. The suspension membrane is coupled to the hoop at an outside diameter of the suspension membrane. The piezoelectric membrane has a circular configuration that is fixed at an outer periphery to the suspension membrane. Typically, the suspension membrane is an annular member, but other shapes may be employed.

The piezoelectric membrane should have an acoustic impedance that is sufficiently close to the acoustic impedance of a liquid into which the device is to be immersed, so that the membrane is substantially transparent to acoustic waves to be encountered. An acceptable material is PVDF, but the copolymer P(VDF-TrFE) is preferred because of its flexibility with regard to the poling process. A region of the polymer is poled to provide an active area that is strongly piezoelectric. Electrodes on the opposed sides of the active area conduct electrical charge that is generated by transduction of acoustic waves. A patterned metallization provides the electrodes, as well as signal and ground traces to the electrodes.

The signal and ground traces extend from the inner piezoelectric membrane to the outer suspension membrane. A preamplifier is mounted to the suspension membrane to amplify the electrical charge and to provide an impedance match with a transmission cable connected to the hydrophone. Unlike the piezoelectric membrane, the frequency response of the hydrophone is not directly linked to the thickness of the suspension membrane. Thus, the thickness of the suspension membrane and the material used to form the membrane may be selected to achieve desired mechanical properties, e.g., mechanical rigidity. An acceptable material for forming a suspension membrane is polyimide. The material should be moderately inert in the liquid environment, should be strong, and ideally has an acoustic impedance that matches the liquid environment.

Often a hydrophone is immersed in a liquid in a position to encounter an ultrasonic field to be characterized. The hydrophone is then periodically relocated to scan the region of interest, i.e. the focal axis and its surroundings. The data can then be pieced together to form a two-dimensional map of acoustic intensity. The rate at which the hydrophone can be relocated is determined by how fragile the hydrophone is and how great of a drag the hydrophone presents. The present invention may be used to increase the ability of the hydrophone to withstand stresses encountered during a scanning sequence. Moreover, the mechanical drag can be reduced by removing regions within the suspension membrane, thereby allowing the flow of liquid therethrough.

The scanning sequence may be eliminated altogether by providing an array of poled active areas. Preferably, each active area is operationally associated with a different preamplifier. This design may be utilized to provide a "real time" beam profile of the ultrasonic field.

In a preferred embodiment, the suspension membrane includes a metallization that is patterned to provide dimensional stability. Immersing a membrane hydrophone in a liquid may change the dimensions of the membrane if a significant quantity of water is absorbed. A metallization pattern can be used to reduce dimensional changes. Moreover, the metallization can be patterned to act as a rip-stop, wherein the susceptibility of a thin membrane to tearing is reduced. This rip-stop feature may be achieved by patterning copper to include traces along the inside diameter of the suspension membrane and along any edges of cutout areas.

An advantage of the present invention is that a membrane hydrophone can be fabricated such that its support structure is beyond the diameter of acoustic beams of interest, without requiring that a piezoelectric polymer extend entirely from a central active area to the support structure. The piezoelectric membrane can be selected for its transduction properties, while the suspension membrane is selected for its mechanical properties. For example, the piezoelectric membrane may be a suspension membrane may be a polyimide film having a thickness of 25 $\mu$m The suspension membrane preferably is a bilaminate membrane that provides rf shielding.

BEST MODE FOR CARRYING OUT THE INVENTION

Figure 1:
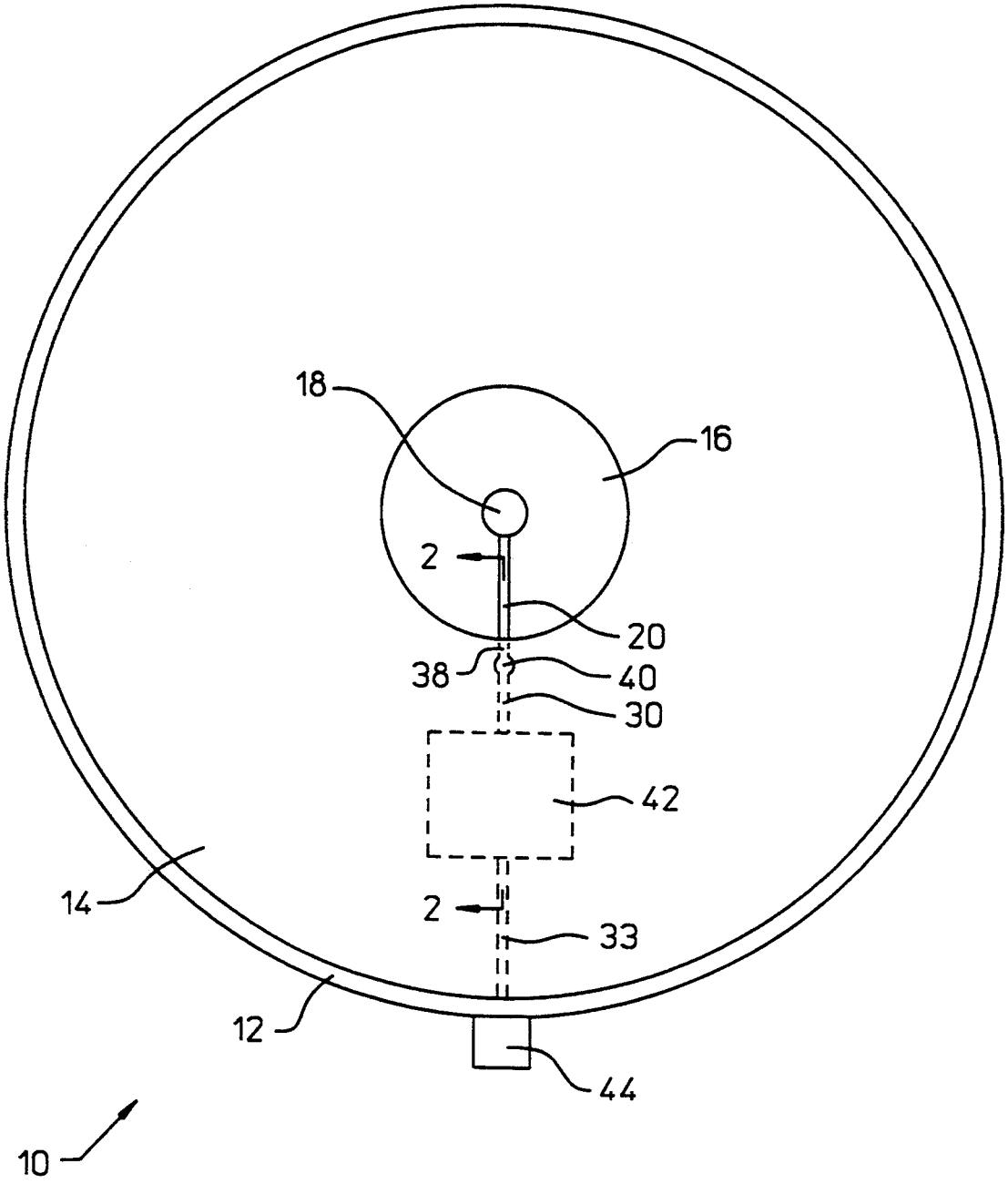
FIG. 1 is a top view of a membrane hydrophone in accordance with the present invention.

With reference to FIG. 1, a membrane hydrophone 10 is shown as including a hoop structure 12 that supports an annular suspension membrane 14. The suspension membrane is held in a tightly stretched condition by the hoop structure. This may be accomplished by providing a compressive force at the outside diameter of the suspension membrane.

The hydrophone 10 may be of the type used to characterize acoustic fields produced by medical ultrasound transducers. The diameter of the hoop structure may be between 5 cm and 14 cm, but neither the shape nor the dimensions is critical to the present invention.

Supported within the inside diameter of the suspension membrane 14 is a piezoelectric membrane 16. The piezoelectric membrane may be made of any material having piezoelectric properties which allow localized poling to provide an active area for converting acoustic waves to an electric charge. A preferred material is P(VDF-TrFE), but other materials may be used. Semicrystalline polymers and copolymers possess the piezoelectric and acoustic properties that facilitate fabrication of a high performance ultrasonic device.

An electrode 18 is formed at the central region of the piezoelectric membrane 16. While not shown, a second electrode is formed on a side of the membrane 16 opposite to the upper electrode 18. A conductive trace 20 extends from the electrode 18 for the conduction of current. During fabrication, an electric field is applied to the central region of the piezoelectric membrane 16 by the opposed electrodes. The combination of the applied field and an elevated temperature for a set period of time causes poling at the central region, thereby providing a strongly piezoelectric region between the electrodes. Poling parameters are well known in the art.

The conductive trace 20 may be a CrAu member that is formed simultaneously with the electrode 18 by photolithographically patterning a CrAu film formed on the piezoelectric membrane 16. Other metallization schemes may be used, but care must be taken to provide the combination of good electrical conductivity and the desired degree of flexibility. Flexibility is an issue, since a brittle, rigid metal would crack during use of the hydrophone.

Figure 2:
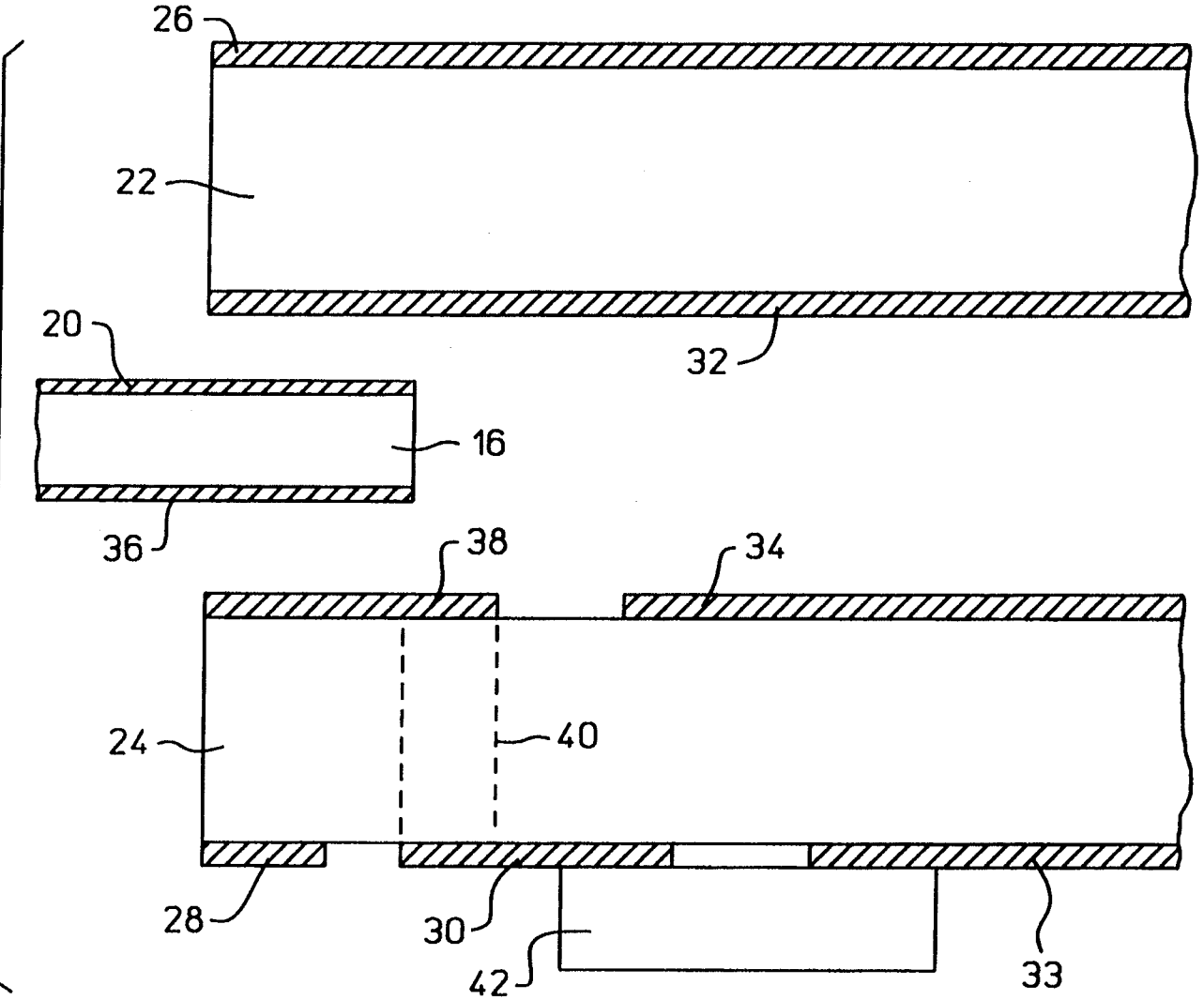
FIG. 2 is an exploded partial side sectional view of a preferred embodiment of membranes, taken along lines 2—2 of FIG. 1.

In a preferred embodiment, the annular suspension membrane 14 of FIG. 1 has a bilaminate design that includes upper and lower membranes 22 and 24. The advantages of bilaminate membranes are known in the art. The primary advantage is that the external surfaces of a bilaminate membrane can be coated with a metal film that is grounded, thereby providing an rf shield similar to coaxial transmission. In FIG. 2, the outer surface of the upper membrane 22 is coated with a grounded copper layer 26. The external surface of the lower membrane 24 also includes a grounded layer 28, other than at areas having signal traces 30 and 33.

The interior surfaces of the upper and lower membranes 22 and 24 also have ground-plane layers 32 and 34. The membranes 16, 22 and 24 may be bonded together using a low viscosity adhesive. The adhesives presently employed in joining two P(VDF-TrFE) layers of a bilaminate hydrophone may be used to couple the two membranes that comprise the suspension membrane and to couple the suspension membrane to the piezoelectric membrane 16.

The conductive trace 20 on the upper surface of the piezoelectric membrane 16 is a ground trace that is electrically connected to the ground-plane layer 32 of the upper membrane 22. On the bottom surface of the piezoelectric membrane is a signal trace 36 that leads to an electrode, not shown, on the side of the active area opposite to the electrode 18. Following bonding of the piezoelectric membrane to the suspension membrane, the signal trace 36 is in electrical contact with a signal trace 38 on the interior surface of the lower membrane 24. Thus, an electric charge that is generated by the active area of the piezoelectric membrane as a result of receiving acoustic waves is conducted from the signal trace 36 to the signal trace 38 of the suspension membrane. From the trace 38, the electric charge is conducted through a plated via 40 to an input signal trace 30 of a preamplifier 42.

The preamplifier 42 amplifies the electric charge, which is then conducted to a coaxial cable jack 44. In addition to providing amplification, the preamplifier is used to achieve impedance matching to a cable that is joined to the jack 44. In operation, it is typical to connect a 50 ohm cable having a length of 1 meter from the jack 44 to an oscilloscope. For many conventional hydrophones, losses that occur because of an impedance mismatch between the hydrophone and the cable may be acceptable losses. However, as operation frequencies increase to levels permitted by the thin piezoelectric membrane 16 to be described more fully below, electrical impedance of the hydrophone raises to a level at which such losses are less acceptable. Consequently, the importance of the preamplifier 42 is increased as the piezoelectric membrane 16 is reduced in thickness and the operating frequency is increased.

Employing the suspension membrane 14 of FIG. 1 allows the hoop structure 12 to have a diameter greater than the diameter of an ultrasonic field to be characterized, but permits the piezoelectric membrane to have a diameter less than that of the hoop structure. Conventional membrane hydrophones have a piezoelectric membrane that stretches to the hoop structure, limiting reductions in thickness of the membrane. A membrane must be sufficiently robust to withstand the stresses encountered during operation. Standard P(VDF-TrFE) membrane hydrophones have a thickness of 25 μm, with the bilaminate design increasing the thickness to 50 μm. Because the thickness of a piezoelectric membrane plays a role in determining the sensitivity at high frequencies, a limit on reductions of thickness imposes a barrier to extending the frequency range of a membrane hydrophone.

As compared to the prior art, the reduction in the lateral dimension of the piezoelectric membrane 16 of FIGS. 1 and 2 permits further reductions in the thickness of the membrane without jeopardizing the ability of the hydrophone to withstand stresses. In FIG. 2, the thickness of the piezoelectric membrane 16 may be 4 μm. The upper end of a frequency range can then more easily be brought to 100 MHz.

As noted above, the selection of a material to form the piezoelectric membrane 16 is based primarily on the piezoelectric and acoustic properties of the material. In comparison, the selection of the material for forming the upper and lower membranes 22 and 24 of the suspension membrane can be based primarily on the mechanical properties, although acoustic impedance is a concern. Polyimide is the material of choice, since it is moderately inert and provides the desired mechanical strength. Polyimide having metallic films on opposed sides is commercially available, so that the signal traces and ground planes described above can be easily formed by merely patterning the metallic films. Another acceptable material is the polyester film sold by Dupont Corporation under the trade name MYLAR. Such a film has a high tensile strength.

While not critical, the upper and lower membranes 22 and 24 may each have a thickness of 25 μm. A ring of metallization may be formed along the inside diameters of the upper and lower membranes to prevent ripping of the polyimide. This rip-stop feature is shown at reference numeral 28 in FIG. 2. In addition to reducing the risk of tearing, a ring of metal would add to the dimensional stability of the membrane. When inserted into a liquid, the P(VDF-TrFE) membrane 16 may absorb a quantity of the liquid, thereby changing the dimensions of the membrane. A thin metal ring would provide dimensional stability without adding substantially to the mechanical load.

Figure 3:
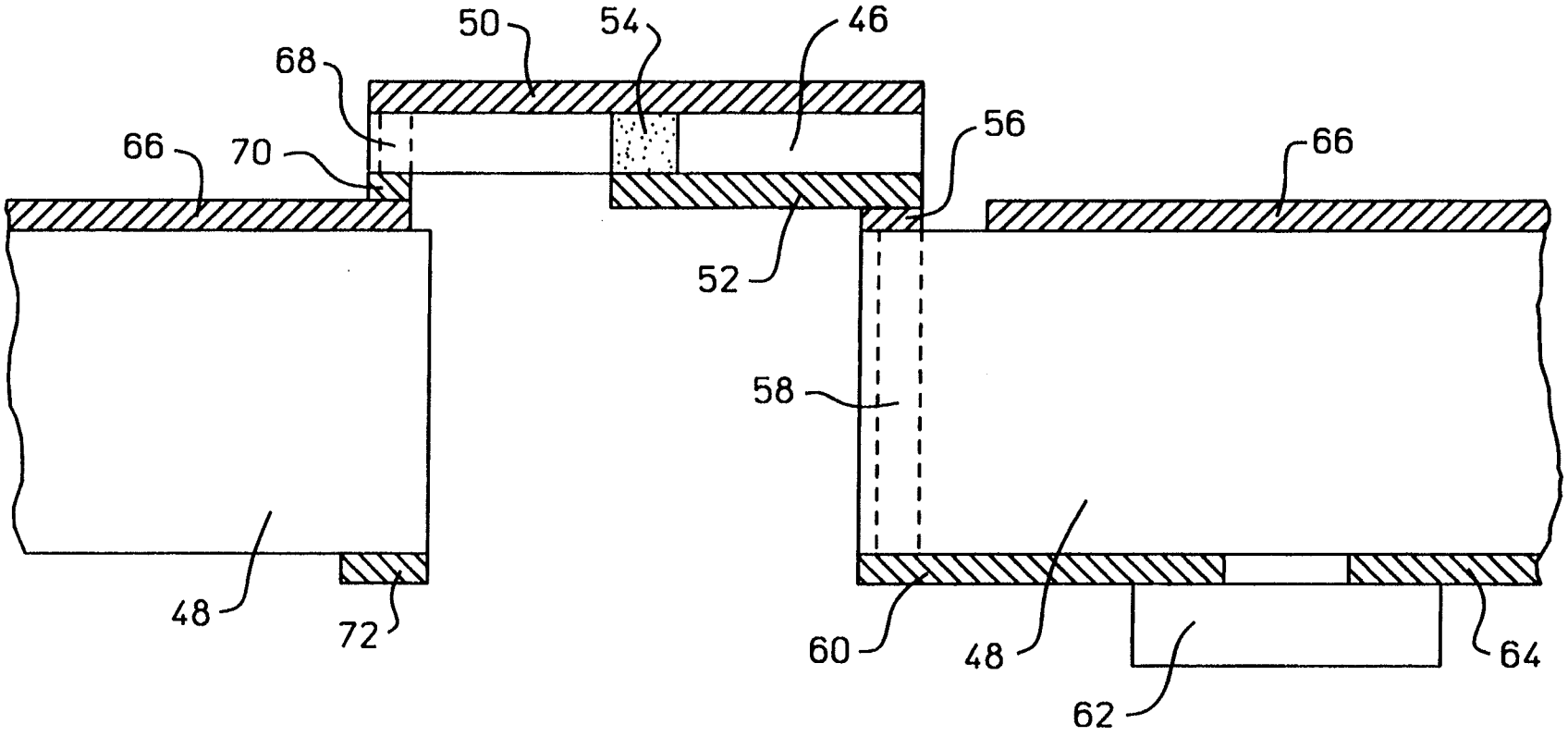
FIG. 3 is a side sectional view of a second embodiment of the membranes of FIG. 1.

The embodiment of FIG. 2 is referred to as a "ground-forward design," since the face of the piezoelectric membrane 16 that is directed at incoming acoustic waves has a grounded metallization. FIG. 3 shows an alternative embodiment of a ground-forward hydrophone. The hydrophone includes a piezoelectric membrane 46 supported by an annular polyimide suspension membrane 48. A ground-plane layer 50 is formed atop the piezoelectric membrane. On a rearward face of the membrane is a signal trace 52 that extends to a piezoelectrically active area 54.

A signal from the signal trace 52 is received at a contact 56 on the suspension membrane 48. A signal is conducted through a plated via 58 to an input trace 60 of a preamplifier 62. From the preamplifier, the signal is transmitted through an output trace 64.

Like the piezoelectric membrane 46, the suspension membrane 48 includes a ground-plane layer 66 at a forward face. Ground potential at the layer 50 of the piezoelectric membrane is ensured by means of a plated via 68 and a contact 70 of the piezoelectric membrane.

A ring of thin metal is formed on the rearward face of the suspension membrane along the inside diameter of the membrane. The ring of metal is interrupted only at the input trace 60. The metal ring provides the dimensional stability and rip-retarding advantages described above.

The suspension membrane 48 extends to a support structure, such as a hoop. Thus, the piezoelectric membrane 46 need only extend across the opening in the suspension membrane. This permits the membrane to be thin, e.g., 4 μm. Having a piezoelectric membrane with a thickness less than 10 μm allows further improvements in performance of the hydrophone.

Figure 4:
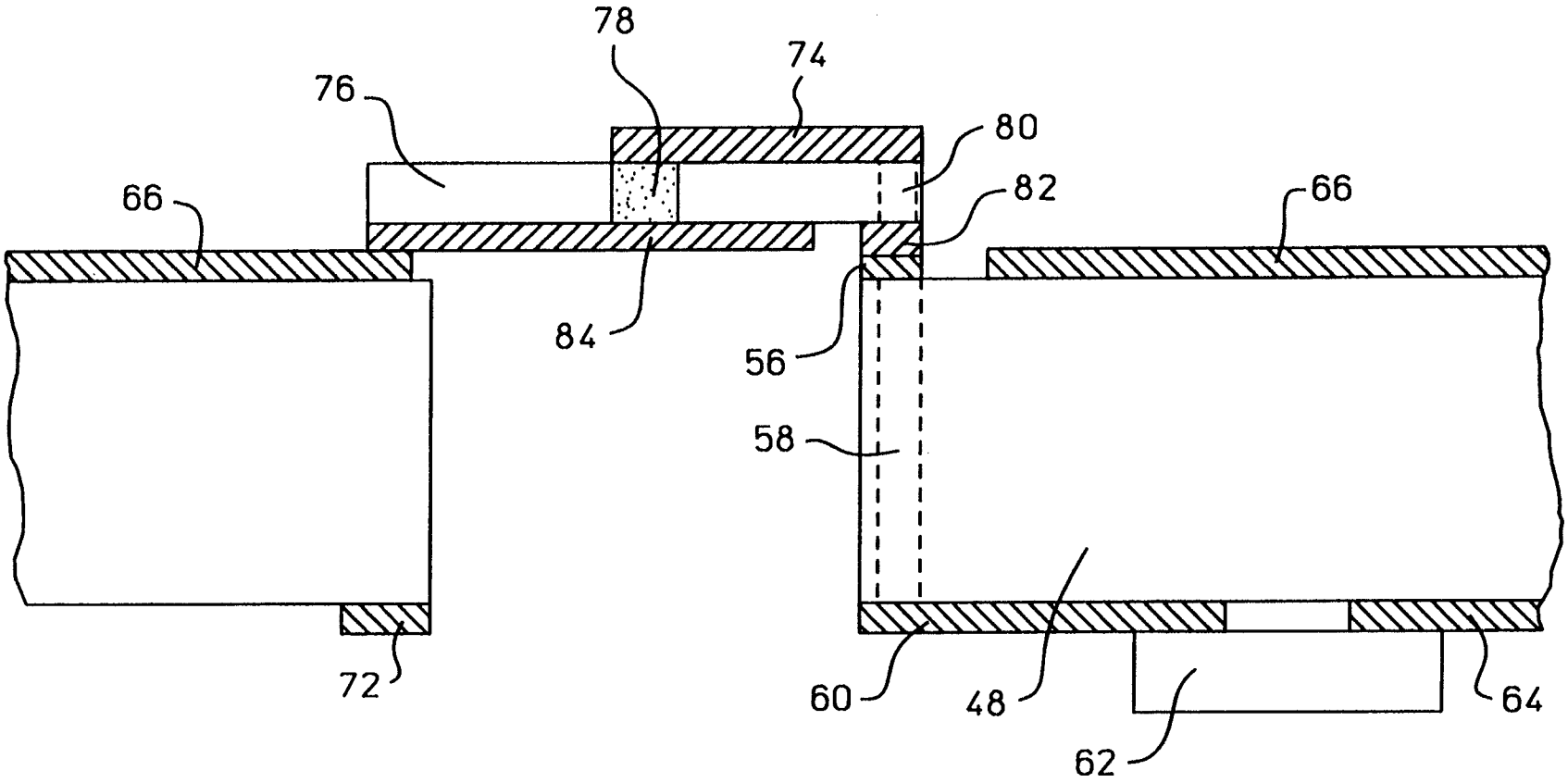
FIG. 4 is a side sectional view of a third embodiment of membranes of FIG. 1.

FIG. 4 illustrates a single-sheet, signal-forward embodiment in which a signal trace 74 is along a forward face of a piezoelectric membrane 76. The signal trace extends from a piezoelectrically strong active area 78 to a plated via 80. A contact 82 on the rearward face of the membrane is aligned to electrically conduct electrical charge from the piezoelectric membrane 76 to a suspension membrane 48. The suspension membrane is identical to the one described with reference to FIG. 3. A ground-plane layer 84 is formed on the rearward face of the piezoelectric membrane 76.

Returning to FIG. 1, characterizing an ultrasonic field often includes scanning a region of interest that includes the focal axis and its surroundings. Data that is collected during the scanning is then pieced together to form a two-dimensional map of acoustic intensity. A problem with moving a membrane hydrophone 10 is that the membrane that is unsupported at its center will flex under the pressure of the liquid. The membrane is therefore susceptible to waveform digitization errors. In extreme cases, the membrane will break. Therefore, the membrane is typically moved slowly and the process is periodically stopped to allow membrane vibration to dampen out.

Figure 5:
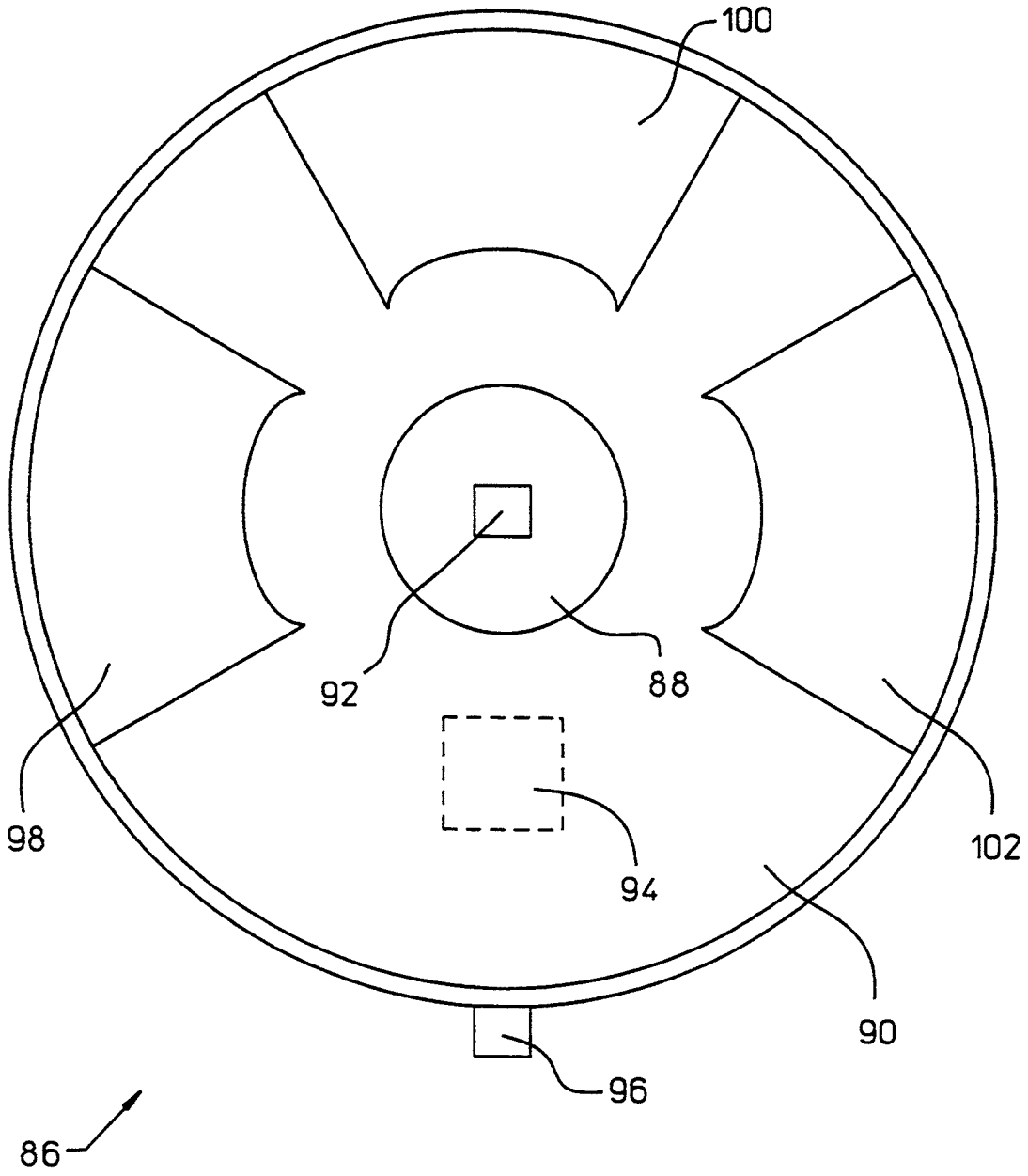
FIG. 5 is a top view of a second embodiment of a membrane hydrophone in accordance with the present invention.

FIG. 5 is a top view of an embodiment of a membrane hydrophone 86 that alleviates the problem of membrane vibration. A piezoelectric membrane 88 is at a center of a suspension membrane 90 in the same manner as described above. The piezoelectric membrane includes an active area 92. Electrical charge that is sensed at the active area is amplified at a preamp 94 and transmitted through a cable connected to the hydrophone at a jack 96. The hydrophone of FIG. 5 differs from the one of FIG. 1 in that the suspension membrane 90 includes regions that are cutaway in order to reduce the mechanical drag. Here, cutaway regions 98, 100 and 102 are shown. Ideally, the cutaway regions are symmetrically arranged so that the tension on the piezoelectric membrane 88 is generally uniform about its outer edge. The suspension membrane should have a rip-stop metallization at the cutaway regions.

Figure 6:
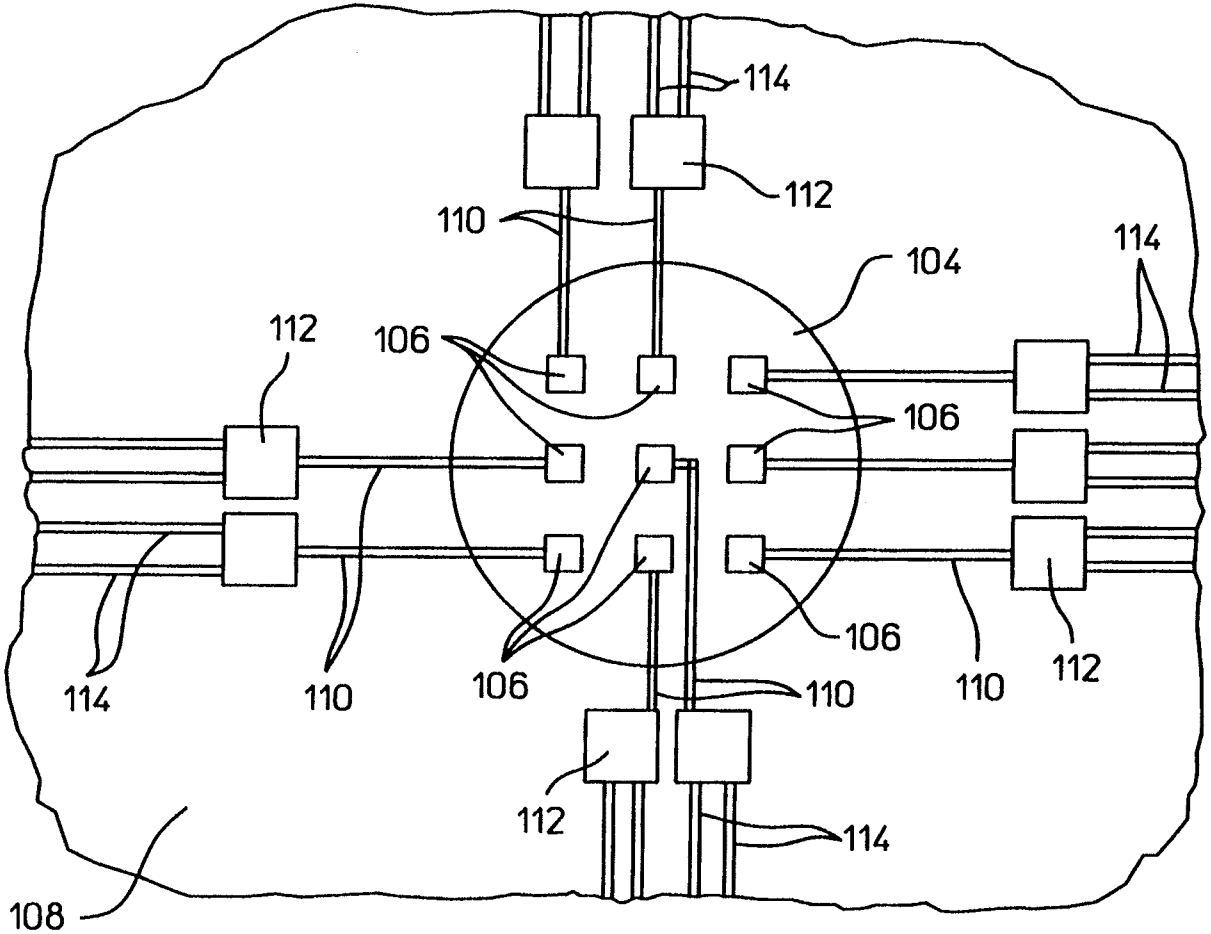
FIG. 6 is a partial top view of a third embodiment of a membrane hydrophone in accordance with the present invention.

FIG. 5 illustrates a means of reducing the adverse effects of drag that are encountered in scanning a hydrophone. Alternatively, a piezoelectric membrane may include an array of active areas, allowing the membrane hydrophone to be fixed in place. FIG. 6 illustrates a central piezoelectric membrane 104 having nine active elements 106. The $3\times3$ array is merely exemplary, since preferably the array includes a greater number of active elements. Such an array permits a "real time" beam profile that can be achieved without moving the hydrophone.

The piezoelectric membrane 104 is supported by a suspension membrane 108. Input traces 110 conduct charge from the active elements 106 to preamps 112. Output traces 114 transmit the amplified signals to cables, not shown.

While the present invention has been described with reference to a membrane hydrophone, the invention can be employed with other acoustic devices in which a piezoelectric membrane is fixed to a support structure. The incorporation of a suspension membrane as described above permits the piezoelectric membrane to be designed with more of a focus on enhancing performance and less of a focus on mechanical properties such as rigidity. Furthermore, while the device has been described and illustrated as having a circular configuration, the device may have other shapes, such as an octagonal configuration.

I claim:

1. An acoustic device comprising:

a support structure having an interior;

an outer suspension membrane fixed to said support structure and extending from said support structure to said interior, said outer suspension membrane having an opening therethrough;

an inner transducer membrane suspended within said interior in spaced relation to the support structure by said outer suspension membrane, said inner transducer membrane having a piezoelectrically active area aligned with said opening through said outer suspension membrane;

means for attaching said outer suspension membrane to said inner transducer membrane; and electrode means for conducting electrical charge from said piezoelectrically active area.

2. The device of claim 1 wherein said outer suspension membrane and said inner transducer membrane are formed of different materials and have different thicknesses.

3. The device of claim 1 wherein said support structure is an annular member and said inner transducer membrane is concentric with said support structure, said inner transducer membrane being a piezoelectric polymer.

4. The device of claim 1 further comprising a preamplifier coupled to said outer suspension membrane, said preamplifier electrically coupled to said piezoelectrically active area.

5. The device of claim 1 wherein said outer suspension membrane has cutaway regions to reduce the surface area of the outer suspension membrane.

6. The device of claim 1 wherein said inner transducer membrane is a piezoelectric polymer having a plurality of poled areas to form an array of piezoelectrically active areas.

7. The device of claim 1 wherein said outer suspension membrane is an annular polyimide substrate having an outside diameter connected to said support structure, said inner transducer membrane being a P-(VDF-TrFE) membrane attached at the inside diameter of said outer suspension membrane.

8. The device of claim 1 further comprising a patterned metallic layer disposed upon a first surface of the outer suspension membrane to provide mechanical rigidity and dimensional stability.

9. The device of claim 1 wherein said inner transducer membrane is adhesively bonded to the outer suspension membrane.

10. The device of claim 1 further comprising conductor means on said outer suspension membrane and said inner transducer membrane for conducting signals from said electrode means.

11. A hydrophone comprising:

a support membrane;

a planar first membrane having an inside edge and an outside edge, said first membrane coupled at said outside edge to said support member;

a piezoelectric polymer membrane connected to said first membrane proximate to said inside edge, said piezoelectric polymer membrane having a poled active area having an acoustic propagation axis, said first membrane and said piezoelectric polymer membrane being generally parallel and being offset in the direction of said acoustic propagation axis; and means electrically connected to said poled active area for conducting electrical charge therefrom.

12. The hydrophone of claim 11 wherein said first membrane is formed of polyimide.

13. The hydrophone of claim 11 wherein said piezoelectric polymer membrane has a thickness less than 10 $\mu$m.

14. The hydrophone of claim 11 wherein portions of said first membrane are removed.

15. The hydrophone of claim 11 further comprising a preamplifier affixed to said first membrane, said preamplifier electrically connected to said means for conducting electrical charge.

16. The hydrophone of claim 11 further comprising a patterned metallic layer disposed upon a first surface of said first membrane and proximate to said inside edge of said first membrane to provide mechanical rigidity.

17. The hydrophone of claim 11 wherein said piezoelectric polymer membrane includes an array of poled active areas.

18. The hydrophone of claim 17 further comprising a plurality of preamplifiers, each preamplifier being electrically connected to one of said poled active areas.

19. The hydrophone of claim 11 wherein said first membrane is a bilaminar membrane.

20. A hydrophone comprising:

a support structure having an interior;

an annular outer suspension membrane fixed to said support structure and extending from said support structure to said interior;

an inner transducer membrane suspended within said interior in spaced relation to the support structure by said outer suspension membrane, said inner transducer membrane having a piezoelectrically active region, the area of said active region being smaller than the entire area of said inner membrane; and electrode means for conducting electrical charge from said piezoelectrically active region.

* * * * *